United States Patent [19]

Stone et al.

[11] 4,446,712

[45] May 8, 1984

[54] PROPPED CANTILEVERED ROLL STAND

[75] Inventors: Kenneth R. Stone, Carrollton, Ga.; Bapa R. Uppaluri, Sharon Hill, Pa.

[73] Assignee: Southwire Company, Carrollton, Ga.

[21] Appl. No.: 330,292

[22] Filed: Dec. 14, 1981

[51] Int. Cl.[3] ..... B21B 31/26

[52] U.S. Cl. ..... 72/243; 72/248

[58] Field of Search ..... 72/237, 241, 243, 248

[56] References Cited

U.S. PATENT DOCUMENTS

| | | | |
|---|---|---|---|
| 1,900,032 | 3/1933 | Worthington | 72/243 |
| 3,587,267 | 6/1971 | Townsend et al. | 72/237 |
| 3,718,026 | 2/1973 | Gawlikowicz et al. | 72/243 |

FOREIGN PATENT DOCUMENTS

| | | | |
|---|---|---|---|
| 757238 | 9/1980 | U.S.S.R. | 72/366 |

*Primary Examiner*—Lowell A. Larson

*Attorney, Agent, or Firm*—Herbert M. Hanegan; Roberts S. Linne; Michael C. Smith

[57] ABSTRACT

An apparatus for substantially eliminating deflection of cantilevered work roll shafts and work rolls of a cantilevered type rolling mill comprising adjustable work roll support rollers which rotatably brace work rolls at points approximately 180 angular degrees from the metal stock and work roll contact area.

4 Claims, 1 Drawing Figure

PROPPED CANTILEVERED ROLL STAND

TECHNICAL FIELD

The present invention relates generally to metal rolling, and specifically to apparatus for limiting cantilevered roll shaft deflection and associated problems in a cantilevered roll stand.

BACKGROUND ART

Cantilevered roll stands are well known in the art. Examples are shown in U.S. Pat. Nos. 3,257,835, 3,317,994, 3,296,682, 3,517,537, 3,672,199, 3,766,763, 3,881,336, 3,881,337, 4,087,898, 4,159,633, 4,193,823 and Re. 28,107. The main advantage of a cantilevered roll stand over a straddle mount type roll stand is the fact that cantilevered work rolls are readily accessible and adjustable without dismantling a great portion of the roll stand. The main disadvantage of a cantilevered roll stand is the fact that cantilevered work roll shafts are supported only on one end, and as a result, cantilevered shafts tend to bend and deflect away from metal stock upon which their rolls work. As the shafts rotate, the work roll pressure points and the directions of roll shaft deflection continuously change which causes the roll shafts to fatigue at an accelerated rate.

Inherent in the design of prior art cantilevered roll stands is vulnerability to a severe deflection of the roll shafts, and a large radial load on the roll shaft bearings nearest the work rolls. The prior art has compensated somewhat for this deflection problem by using roll shafts of enormous size and great strength to transmit driving force to work rolls which deform and reduce comparatively small metal stock. However, strengthening and oversizing of roll shafts has not substantially decreased shaft deflection and bending moment and also has not decreased loads to related components such as bearings.

The present invention solves these problems by providing an apparatus which rotatably braces work rolls at points approximately 180 angular degrees from the metal stock and work roll contact area to substantially eliminate deflection of the work rolls and the cantilevered shafts. As a result, the service life of cantilevered roll shafts and related components is greatly increased.

DISCLOSURE OF INVENTION

The present invention is an apparatus for substantially eliminating deflection of cantilevered roll shafts and related components of cantilevered type rolling mills. It comprises work roll backup rollers which rotatably brace work rolls at points approximately 180 angular degrees from the metal stock and work roll contact area to maintain the work rolls in predetermined positions.

A major object of the present invention is to provide an apparatus for reducing the fatigue rate of cantilevered roll shafts of a rolling mill by limiting roll shaft bending moment and deflection.

Another object of the present invention is to provide an apparatus which will contribute to a more accurate bar path by maintaining the cantilevered work rolls in predetermined positions.

Still another object of the present invention is to provide an apparatus which will contribute to production of more symmetrical and uniform rod by limiting cantilevered roll shaft and cantilevered roll deflection.

Yet another object of the present invention is to provide an apparatus for limiting cantilevered roll shaft bending moment and deflection and to increase the service life of other roll stand components such as bearings by decreasing the load thereon.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawing wherein:

BEST MODE FOR CARRYING OUT THE INVENTION

Figure 1:
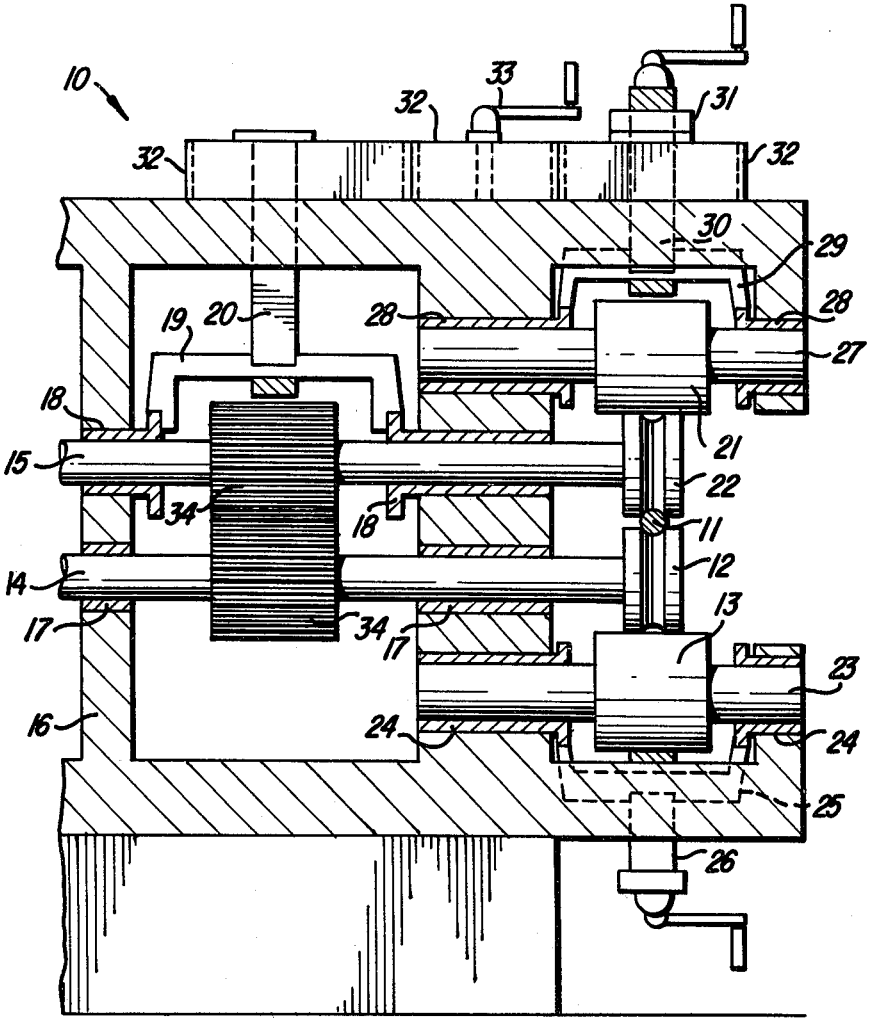
FIG. 1 is a cross sectional view of a cantilevered roll stand wherein the preferred embodiment of the present invention is utilized.

The present invention is an apparatus for substantially eliminating deflection of cantilevered roll shafts and related components of a cantilevered type rolling mill.

As the single figure illustrates, work rolls 12 and 22 of a cantilevered type roll stand indicated generally at 10 are supported at points approximately 180 angular degrees from the area of contact between metal stock 11 and work roll 12 and 22 by support rollers 13 and 21. Force exerted against work rolls 12 and 22 by metal stock 11 is opposed and balanced by support rollers 13 and 21 to substantially eliminate movement of work rolls 12 and 22 away from their predetermined positions and deflection of the cantilevered work roll shafts 14 and 15.

While cantilevered roll shaft 14 is shown as a lower shaft and cantilevered roll shaft 15 is shown as an upper shaft, it should be noted that in a rolling mill having alternating generally horizontal and generally vertical roll stands 10, roll shafts 14 and 15 may be designated as left and right shafts and therefore will somtimes be referred to hereinafter as first cantilevered roll shaft 14 and second cantilevered roll shaft 15. At least one of the roll shafts 14 or 15 must be capable of being adjusted away from and toward the other roll shaft 14 or 15 to adjust the gap between the work rolls 12 and 22. It is preferred that first roll shaft 14 be rotatably secured to the frame 16 of the roll stand 10 by bearings 17 in a non-adjustable manner such that in the absence of external forces, the longitudinal axis of roll shaft 14 is substantially stationary. Second roll shaft 15 is rotatably and adjustably secured to frame 16 by eccentric bearings 18 in such a manner that the longitudinal axis of roll shaft 15 may be adjusted toward and away from the longitudinal axis of roll shaft 14 by rotation of eccentric bearings 18. Gears 34, mounted on roll shafts 14 and 15, interconnect roll shafts 14 and 15 for uniformity of rotation, and have sufficient tooth depth to maintain gear mesh over the roll gap adjustment range. The term eccentric bearing as used herein is defined as a concentric bearing carried within an eccentric cartridge. Eccentric bearings 18 operate in the conventional manner shown in U.S. Pat. Nos. 3,388,578; 4,035,044 and 2,986,086. Yoke 19 interconnects eccentric bearings 18 and controls their rotation in unison. Yoke 19 is rotatable about the longitudinal axis of the eccentric bearings 18 at the command of yoke control screw 20 which is threaded into a portion of yoke 19 and rotatably secured to frame 16 in such a manner that rotation of yoke control screw 20 forces yoke 19 to rotate about the longitudinal axis of eccentric bearings 18. This adjustability allows adjustment of the roll gap and allows the second shaft 15 to be moved away from the first shaft 14 when rolls 12 or 22 must be replaced. While in roll stands 10 having two work rolls 12 and 22 the longitudinal axes of work roll shafts 14 and 15 are maintained in substantially parallel alignment by the mounting and adjustment means described above, the pressure of metal stock 11 against work rolls 12 and 22 concentrically mounted on shafts 14 and 15 tends to deflect shafts 14 and 15 apart.

A first support roller 13 is provided adjacent to work roll 12 of the first roll shaft 14 such that a plane passing through the longitudinal axis of work roll 12 and the longitudinal axis of support roller 13 is substantially orthogonal to the longitudinal axis of the metal stock 11 such that the area of contact between stock 11 and work roll 12 is approximtely 180 angular degrees along the periphery of work roll 12 from the area of contact between work roll 12 and support roller 13 to oppose the deflective tendency of shaft 14 caused by metal stock 11. Support roller 13 is concentrically mounted on a first support roller shaft 23 which is rotatably and adjustably secured to frame 16 by eccentric bearings 24 in such a manner that the longitudinal axis of support roller shaft 23 is adjustable toward and away from the longitudinal axis of work roll 12 by rotation of eccentric bearings 24. Yoke 25 interconnects eccentric bearings 24 and controls their rotation in unison by rotation of yoke 25 along the longitudinal axis of eccentric bearings 24 at the command of yoke control screw 26 which is threaded into a portion of yoke 25 and rotatably secured to frame 16 in such a manner that rotation of yoke control screw 26 forces yoek 25 to rotate about the longitudinal axis of eccentric bearings 24 to move the longitudinal axis of support roll 13 toward or away from the longitudinal axis of work roll 12. This adjustability allows support roll 13 to be pre-loaded against work roll 12 in the direction of the metal stock 11 with sufficient force to prevent deflection of work roll 12 and work roll shaft 14 under pressure of metal stock 11, allows compensation for wear to surfaces of work roll 12 and support roller 13, and allows support roller 13 to be moved out of the way when work roll 12 is replaced.

A second support roller 21 is provided adjacent to work roll 22 of the second roll shaft 15 such that a plane passing through the longitudinal axis of work roll 22 and the longitudinal axis of support roller 21 is substantially orthogonal to the longitudinal axis of the metal stock 11 such that the point of contact between stock 11 and work roll 22 is approximately 180 angular degrees along the periphery of work roll 22 from the area of contact between. work roll 22 and support roller 21 to oppose the deflective tendency of shaft 15 caused by metal stock 11. The plane passing through the longitudinal axis of work roll 22 and the longitudinal axis of support roller 21 will be substantially the same plane passing through the longitudinal axis of work roll 12 and the longitudinal axis of support roller 13 if the roll stand 10 comprises two work rolls, but where three work rolls are employed, three separate planes substantially orthogonal to the longitudinal axis of the stock 11 will exist. Support roller 21 is concentrically mounted on a second support roller shaft 27 which is rotatably and adjustably secured to frame 16 by eccentric bearings 28 in such a manner that the longitudinal axis of support roller shaft 27 is adjustable toward and away from the longitudinal axis of work roll 22 by rotation of eccentric bearings 28. Yoke 29 interconnects eccentric bearings 28 and controls their rotation in unison by rotation of yoke 29 along the longitudinal axis of eccentric bearings 28 at the command of yoke control screw 30 which is threaded into a portion of yoke 29 and rotatably secured to frame 16 in such a manner that rotation of control yoke screw 30 forces yoke 29 to rotate about the longitudinal axis of eccentric bearings 28 to move the longitudinal axis of support roller 21 toward or away from the longitudinal axis of work roll 22. This adjustability allows support roller 21 to be pre-loaded against work roll 22 in the direction of the metal stock 11 with sufficient force to prevent deflection of work roll 22 and work roll shaft 15 under pressure of metal stock 11, allows compensation for wear to surfaces of work roll 22 and support roller 21, and allows support roller 21 to be moved out of the way during replacement of work roll 22.

Once the desired roll gap and preload adjustments are made, yoke control screw 30 for the second support roller 21 of work roll 22 of adjustable work roll shaft 15 is locked by means of a locking device 31 into synchronization with yoke control screw 20 for adjustable work roll shaft 15. This synchronization is achieved by gearing yoke control screws 20 and 30 together by gears 32 which are operated by a main adjustment drive mechanism 33. As routine roll gap adjustments are made by activation of adjustment drive mechanism 33, the support roller 21 preload adjustment is automatically maintained relative to work roll 22. At the same time separate preload adjustability is available by unlocking locking device 31. Yoke control screw 26 of the first support roller 13 does not require such synchronization because roll shaft 14 is not adjustable.

After the roll gap is set and the preload adjustments are made, metal stock 11 is rolled between work rolls 12 and 22 without forcing work rolls 12 and 22 away from their predetermined positions. Thus deflection of work roll shafts 14 and 15 and related components of the cantilevered roll stand 10 is substantially eliminated.

While this invention has been described in detail with particular reference to a preferred embodiment thereof, it will be understood that variations and modifications can be made effective within the spirit and scope of this invention as described hereinbefore and as defined in the appended claims.

INDUSTRIAL APPLICABILITY

This invention is capable of exploitation in the metal working industry. It is particularly useful in a system for continuously hot forming metal rod.

What we claim as the invention is:

1. Apparatus for substantially eliminating deflection of cantilevered work roll shafts and work rolls of a cantilevered type rolling mill caused by resistance of metal stock to compressive forces applied by said work rolls during rolling of metal stock, comprising:

at least one support roller adjacent to each work roll and in the paths of deflection;

a support roller shaft upon which said support roller is concentrically mounted;

means for adjusting the longitudinal axis of said support roller toward and away from the longitudinal axis of said work roll further comprising a first set of at least two eccentric bearings secured to a frame member of said rolling mill, containing end portions of said support roller shaft, and having a longitudinal axis parallel to the longitudinal axis of said support roller shaft, a first yoke interconnecting said first set of eccentric bearings, and first rotation means for rotating said first yoke about the longitudinal axis of said first set of eccentric bearings;

means for adjusting the gap between said work rolls; and means for synchronizing movement of said longitudinal axis adjustment means of said support roller with movement of said roll gap adjustment means.

2. The apparatus of claim 1 wherein said work roll gap adjusting means further comprises:

a second set of at least two eccentric bearings secured to the frame member of said rolling mill, containing portions of a first of said cantilevered work roll shafts, and having a longitudinal axis parallel to the longitudinal axis of said first cantilevered work roll shaft;

a second yoke interconnecting said second set of eccentric bearings; and second rotating means for rotating said second yoke about the longitudinal axis of said of second set of eccentric bearings;

further provided that rotation of said second yoke adjusts the longitudinal axis of said first work roll shaft toward or away from the longitudinal axis of a second of said cantilevered work roll shafts.

3. The apparatus of claim 2 wherein said sychronizing means further comprises:

second gear means rigidly secured to said second rotating means;

first gear means rotatably secured to said first rotating means;

locking means for locking said first gear means into rigid association with said first rotating means; and interconnecting gear means meshed with said second gear means and said first gear means;

further provided that while said locking means is activated, rotation of said second yoke and said first yoke are dependent.

4. The apparatus of claim 3 further comprising means for rotating said interconnecting gear means.

* * * * *